US005337844A

United States Patent [19]

Tibbitts

[11] Patent Number: 5,337,844

[45] Date of Patent: Aug. 16, 1994

[54] DRILL BIT HAVING DIAMOND FILM CUTTING ELEMENTS

[75] Inventor: Gordon A. Tibbitts, Salt Lake City, Utah

[73] Assignee: Baker Hughes, Incorporated, Houston, Tex.

[21] Appl. No.: 915,463

[22] Filed: Jul. 16, 1992

[51] Int. Cl.[5] ..... B23P 5/00; C23C 16/26; E21B 10/46

[52] U.S. Cl. ..... 175/434; 51/293

[58] Field of Search ..... 175/434, 435, 432, 433, 175/420.2

[56] References Cited

U.S. PATENT DOCUMENTS

| | | | |
|---|---|---|---|
| 4,603,082 | 7/1986 | Zelez | 428/336 |
| 4,604,406 | 8/1986 | Hall et al. | 51/293 |
| 4,605,343 | 8/1986 | Hibbs, Jr. et al. | 407/119 |
| 4,698,256 | 10/1987 | Giglia et al. | 428/216 |
| 4,699,227 | 10/1987 | Wardley | 175/329 |
| 4,726,718 | 2/1988 | Meskin et al. | 408/145 |
| 4,728,529 | 3/1988 | Etzkorn et al. | 427/39 |
| 4,976,324 | 12/1990 | Tibbitts | 175/329 |
| 4,987,002 | 1/1991 | Sakamoto et al. | 427/34 |
| 4,990,403 | 2/1991 | Ito | 428/408 |
| 4,997,636 | 3/1991 | Prins | 423/426 |
| 5,011,509 | 4/1991 | Frushour | 51/293 |
| 5,130,111 | 7/1992 | Pryor | 423/446 |
| 5,135,061 | 8/1992 | Newton, Jr. | 175/428 |

FOREIGN PATENT DOCUMENTS 0319926 6/1989 European Pat. Off. .

OTHER PUBLICATIONS

New Synthesis Techniques, Properties and Applications for Industrial Diamond, Paul D. Gigl, IDA Ultrahard Materials Seminar, Toronto, Ontario Sep. 27, 1989.

Crystallization of Diamond From The Gas Phase (Part 1) Andrzej R. Badzian & Robert C. DeVries, Materials Research Bulletin, Mar. 1988.

Crystallization of Diamond Crystals and Films By Microwave Assisted CVD (Part II) A. R. Badzian, T. Badzian, R. Roy, R. Messier, & K. E. Spear Nov. 6, 1987, pp. 1-20.

Synthesis of Diamond Under Metastable Conditions R. C. DeVries, Ann. Rev. Mater. Sci. 1987, pp. 161-187.

*Primary Examiner*—Stephen J. Novosad

*Attorney, Agent, or Firm*—Marger, Johnson, McCollom & Stolowitz

[57] ABSTRACT

A layer of diamond formed by chemical vapor deposition (CVD) is brazed to a drill bit body to form a cutting element thereon. The ability to withstand high temperatures permits the cutting elements to be brazed using alloys requiring much higher temperatures than those used in connection with brazing convention PDC cutting elements. In an infiltrated bit, a CVD cutting element formed by chemical vapor deposition is placed in a bit mold which is thereafter filled with infiltration powder and placed in a furnace with temperature in excess of 1100° Centigrade. The CVD cutting element may also be mounted on a slug or stud via brazing and the slug or stud in turn mounted on or infiltrated into the bit body or brazed thereto.

13 Claims, 2 Drawing Sheets

DRILL BIT HAVING DIAMOND FILM CUTTING ELEMENTS

BACKGROUND OF THE INVENTION

1. Field of the Invention

The present invention relates generally to earth boring drill bits and more particularly to such drill bits having diamond cutting elements.

2. Description of the Related Art

Known drill bits include diamond bits which can be fabricated from either natural or synthetic diamonds. Conventional diamond drill bits utilize a number of different types of diamond cutting elements, for example, polycrystalline diamond compact (PDC) cutters, thermally stable diamond product (TSP) cutters, mosaic-type cutters, and natural and impregnated diamond.

PDC diamond cutting elements can be made by forming an amalgam of crystalline diamond and cobalt which is sintered into disc shapes. Such discs are then bonded, usually by a diamond press, to a tungsten carbide slug. The slug cutters are then attached by drill bit manufacturers to a tungsten carbide slug or stud which is fixed within a drill bit body designed by the bit manufacturer.

TSP cutters are PDC diamond cutting elements from which metallic elements are leached. Some types of TSP cutters replace the interstices from which the cobalt carbide is leached with another element, such as silicone, which has a thermal coefficient of expansion similar to the diamond. TSP cutters may be used to form a mosaic cutter in which a plurality of geometrically-shaped TSP elements are arranged and bonded in a desired shape to form a unitary cutting surface. They also may be used as individual cutters.

Prior art PDC cutting elements degenerate dramatically above a temperature of about 700°-750° Centigrade due to the difference in thermal coefficient of expansion between the diamond and the tungsten carbide. This prevents utilizing high melting-point alloys to bond the PDC cutting element to a carbide slug and also prevents direct infiltration of a PDC cutting element, either by itself or in combination with a slug carrier or stud, into a bit formed by infiltration in a high temperature furnace. Temperatures for forming such bits are typically 1100° Centigrade and above. It would be desirable to provide an artificial diamond having a high resistance to thermal degradation.

U.S. Pat. No. 4,976,324 issued Dec. 11, 1990 to Tibbitts for a drill bit having diamond film cutting surface discloses a bit which includes a cutting element having a PDC diamond substrate which is coated with a vapor deposition diamond film. The PDC element is generally mounted on a supporting member of tungsten carbide which in turn is braised or sintered to a carrier member on the bit body. Also disclosed therein is a TSP cutting element having a diamond film thereon with the TSP element being bonded to a supporting member on the bit body in a known manner.

While the diamond film in the above-captioned Tibbitts patent provide a cutting face having a lower porosity, which is desirable from the standpoint of wear and impact resistance, the PDC elements on which the diamond layer is formed prevent the use of high temperatures in brazing, bonding or infiltration processes for securing the cutting elements to the bit and/or to carrier members which are in turn secured to the bit. While the TSP cutting elements can be subjected to higher temperature than the PDC cutting elements, pure crystalline diamond, such as that created by chemical vapor deposition, has better resistance to temperature and lower porosity. Also, a diamond layer created by chemical vapor deposition can be formed to create a shaped, i.e., non-planar, cutting face.

It would be desirable to provide a drill bit including synthetic diamond cutting elements which are made completely of diamond produced by chemical vapor deposition.

SUMMARY OF THE INVENTION

The present invention comprises a drill bit for earth boring having a body member. At least one cutting element mounted on and protruding from the surface of the body member comprises a layer of diamond formed by vapor deposition. The present invention also comprises a method for making such a bit.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
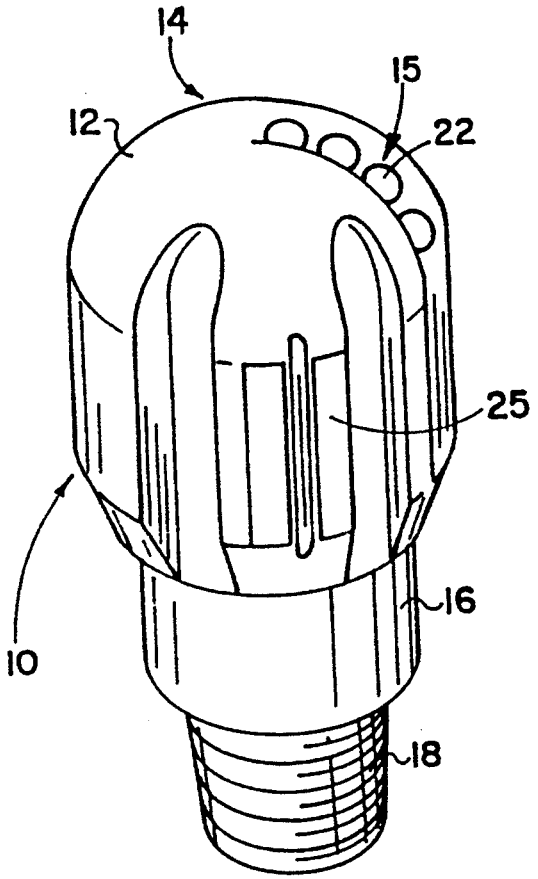
FIG. 1 is a perspective view of an earth boring drill bit constructed in accordance with the present invention.

The present invention provides an improved earth boring drill bit wherein the improvement lies in the diamond cutting element. Referring first to FIG. 1 and indicated generally at 10 is an earth boring drill bit constructed in accordance with the present invention. The drill bit includes a body member 12 which carries a plurality of cutting members, one of which is cutting member 15. Additional cutting members are indicated generally at 14. Body 12 may be a molded component fabricated through conventional metal matrix infiltration technology or may comprise milled steel or other suitable material. Body 12 is coupled to a shank 16 having a threaded portion 18 for connection to a standard drill stem. Shank 16 and body 12 are preferably formed to be functionally integral with one another. Drill bit 10 includes an internal passage (not visible) through which hydraulic fluid can flow. Nozzles (not shown) are formed in body 12 to distribute hydraulic fluid from the passage proximate the faces of cutting members 14.

Figure 2:
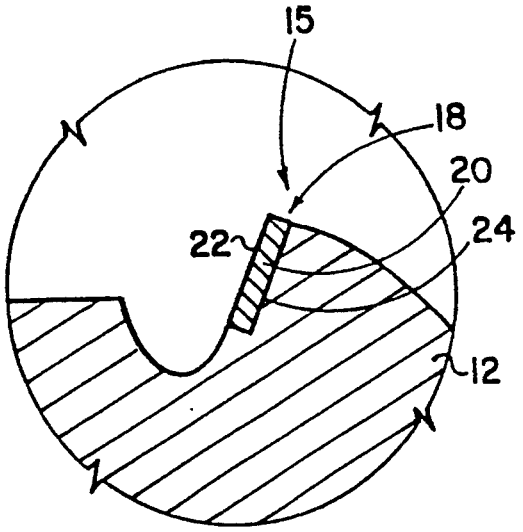
FIG. 2 is an enlarged sectional view of a portion of the bit of FIG. 1.

Referring now to FIG. 2, cutting member 15 includes a cutting element 18 which comprises a diamond layer 20. Diamond layer 20 presents a cutting face 22, viewable in FIG. 1. In the present embodiment of the invention layer 20 is formed by chemical vapor deposition.

Various methods have been devised for forming diamond films or coatings. One such method is disclosed in U.S. Pat. No. 4,707,384. Another method is disclosed by E.V. Spitsyn, et al., "Vapor Growth of Diamond on Diamond and Other Surfaces" J. of Crystal Growth 52, pp. 219-226 (1981). Additional methods are disclosed in U.S. Pat. Nos. 4,486,286; 4,504,519; and 4,645,977 all of which are hereby incorporated herein for all purposes.

In the embodiment of FIG. 2, a bonding layer 24 is formed between a substantially planar surface of body member 12 and a rear face, opposite face 22, of diamond layer 20. In the embodiment of FIG. 2, bonding layer 24 is formed by brazing diamond layer 20 to bit body 12. This is accomplished by using known brazing alloys interposed between layer 20 in the bit body and thereafter heating the same until they melt and form bonding layer 24 which secures layer 20 to bit body 12. As an alternative to brazing, coating techniques known in the art may be used to bond layer 20 to bit body 12. Because layer 20 is substantially pure polycrystalline diamond, it can withstand temperatures substantially above those normally used to secure PDC cutting elements to a bit body and thus alloys with melting points substantially above those normally used to secure PDC cutting elements may be used. Such alloys produce better bonding. Each diamond layer cutting element can be secured to the bit body, one at a time, by brazing using a torch. Alternatively, the alloy can be interposed between each of the diamond layer cutting elements in the bit body and thereafter the entire bit body can be placed in a furnace, in which temperature control more accurate than using a torch is obtained.

European Patent Application No. 881 203 78.0 filed Dec. 6, 1988 discloses a method for bonding a layer of diamond formed by vapor-phase deposition to a machine tool. The diamond film is formed on temporary substrate. The diamond is brazed to the body of the tool and thereafter the substrate is ground away to leave the diamond film affixed to the tool. This technique can be used to mount the diamond cutting elements in the embodiment described above.

A variation on the foregoing technique can also be used in which the diamond film is formed on a permanent substrate which is affixed to the bit body. A substrate suitable for brazing as described above or for creating a bond during infiltration as described below can be used. Such a substrate having suitable characteristics can be chosen by a person with ordinary skill in the art. Because diamond expands very little during heating while the metal of the drill bit could expand significantly, an appropriate coefficient of thermal expansion for the substrate helps prevent damage to the diamond film during drilling.

Known vapor deposition techniques may be used in which the deposited diamond does not attach to a substrate but rather a freestanding diamond layer is deposited.

Several diamond sheets, like diamond sheet 25, are mounted on a gage portion of bit 10 as shown. The diamond sheets bear against the side of the hole during drilling and serve both to form the bore and to prevent excessive wear of bit body member 12. Sheet 25 includes a slight curve along its transverse dimension to correspond to the curve of the gage of the drill bit. Diamond sheet 25 may be formed and brazed onto the gage of bit 10 in the same manner as the cutting elements as described above. It is known in the art to form diamond sheets having curved surfaces as set forth in U.S. Pat. No. 4,987,002 to Sakamotot et al. for a process for forming a crystalline diamond film which is incorporated herein by reference for all purposes.

Both the cutting elements, like cutting element 15, and the diamond sheets, like diamond sheet 25, can be alternately formed by direct chemical vapor deposition onto bit body member 12. Using known techniques, the surface of the bit can be masked leaving an opening at the location at which it is desired to form the deposited diamond cutter.

Figure 3:
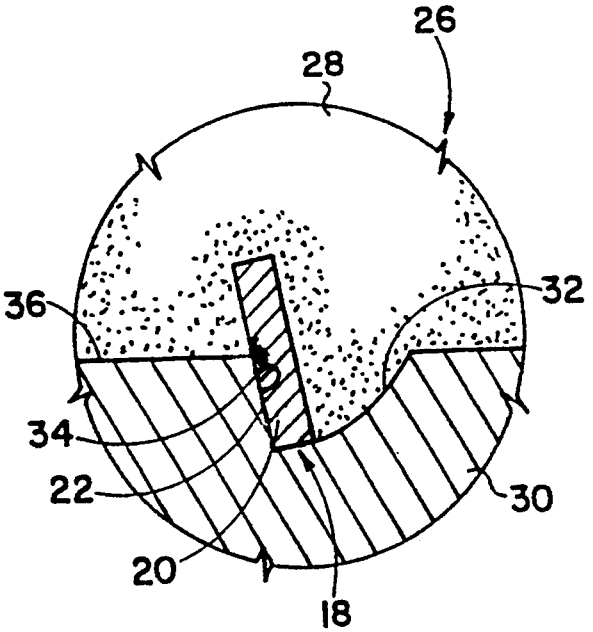
FIGS. 3-8 are each sectional views of different embodiments of the invention including a mold having a drill bit formed therein.

Turning now to FIG. 3, indicated generally at 26 is a partial view of an infiltrated earth boring drill bit received in a mold. In the remaining figures, structure which corresponds to that previously identified retains the same identifying numeral. Included in FIG. 3 is an infiltrated bit body 28 and a mold 30. Bit body 28 is formed by packing conventional infiltration powders in a bit mold and thereafter infiltrating the powder in a furnace. Mold 30 includes a surface 32 which defines a support for the cutting element. A substantially planar surface 34 intersects surface 32 along one edge and intersects another mold surface 36 along a generally opposing edge.

In constructing the bit of FIG. 3, diamond layer 20 is formed as described above using either a process in which the deposited diamond is attached to a substrate or using one in which a freestanding film is created. Any substrate upon which layer 20 is formed is removed. Layer 20 is thereafter inserted into mold 30 and is positioned as shown in FIG. 3. Next, the mold is filled with conventional infiltration powder to form infiltrated bit body 28. Additional cutting elements (not visible in FIG. 3) are placed in the mold prior to packing it with powder.

Next the mold is infiltrated in a furnace in which temperatures routinely exceed 1100° Centigrade. Such temperatures would destroy conventional PDC cutters. After furnacing, the bit is removed from the mold with cutting element 18 beingmechanically held in place by virtue of the bit body surrounding one end thereof.

Figure 4:
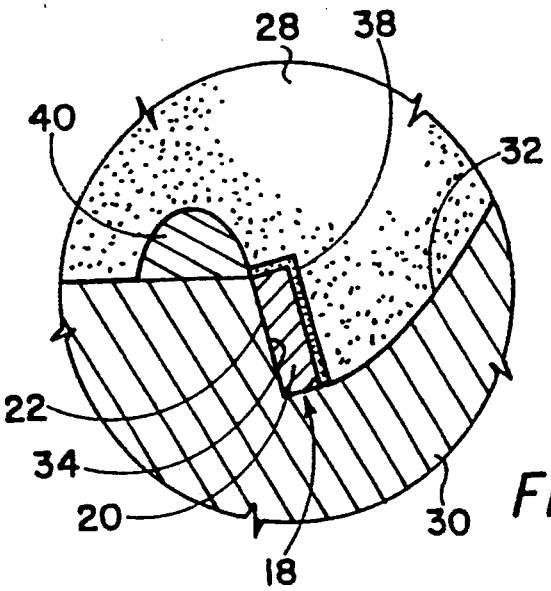

Turning now to FIG. 4, cutting element 18 is secured to bit body 28 via conventional bonding material 38. Mold 30 includes a portion 40 having a transverse semicircular cross-section which defines a waterway in bit body 28.

In manufacturing the bit of FIG. 4, diamond layer 20 is formed as described above and secured, using a conventional adhesive, to the interior of the mold in the position shown in FIG. 4. Thereafter, conventional bonding material is placed on cutting element 18 and the mold is packed with infiltration powder and placed in a furnace. The high temperature forms a solid bit body as well as bonding, via bonding material 38, cutting element 18 to the bit body.

Figure 5:
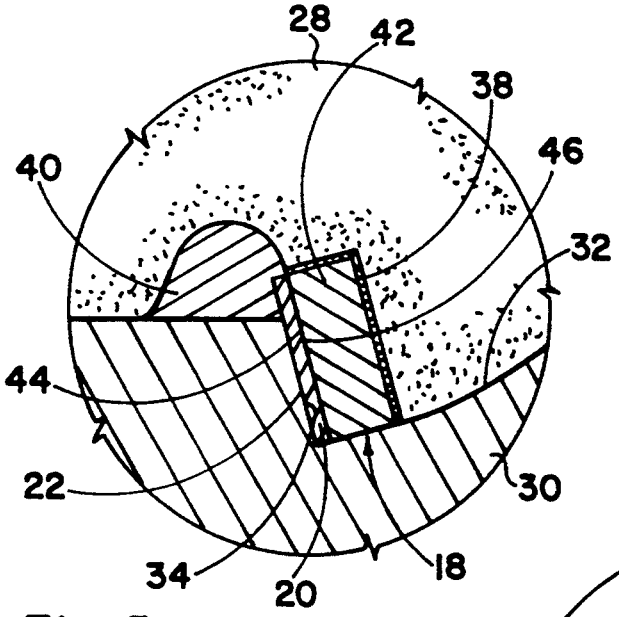

In the embodiment of FIG. 5, diamond layer 20 is secured to a supporting member 42 before either is received in mold 30. Supporting member 42 includes a planar surface 44 which is secured to a rear surface 46 of diamond layer 20. Surfaces 44, 46 have generally the same perimeter and are aligned with one another. Supporting member 42 is typically formed of tungsten carbide. Layer 20 may mounted on supporting member 42 by utilizing brazing with high temperature alloys as described above in connection with attaching the layer to a bit body or by utilizing conventional techniques for mounting PDC cutters on supporting members.

In manufacturing the embodiment of FIG. 5, supporting member 42 with diamond layer 20 mounted thereon is received in mold 30 as shown in FIG. 5. Thereafter bonding material 38 is applied to exposed surfaces of member 42 and the mold is filled with infiltration powder. After furnacing, the bonding material attaches member 42 securely to body 28 in the position shown in FIG. 5. It is to be appreciated that supporting member 42, having diamond layer 20 mounted thereon, can also be mounted on bits other than infiltrated bits, e.g., steel bits. In such cases, the supporting member is brazed to the: bit in a known manner.

Figure 6:
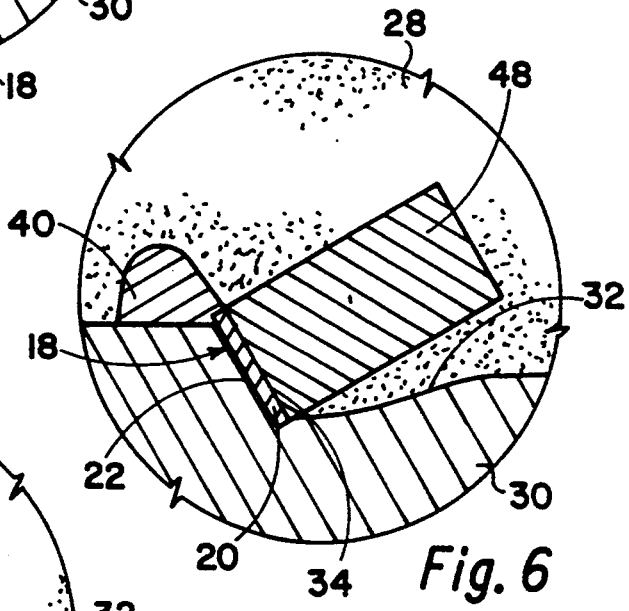

In the embodiment of FIG. 6, layer 20 is secured to a generally cylindrical stud 48 which may be formed of tungsten carbide. Layer 20 may be secured to the stud in the same manner that layer 20 is secured to supporting member 42 in FIG. 5. Thereafter the stud bearing layer 20 thereon is positioned in mold 30 as shown in FIG. 6, the mold is packed with infiltration powder and placed in the furnace to form a bit like that shown in FIG. 6.

Figure 7:
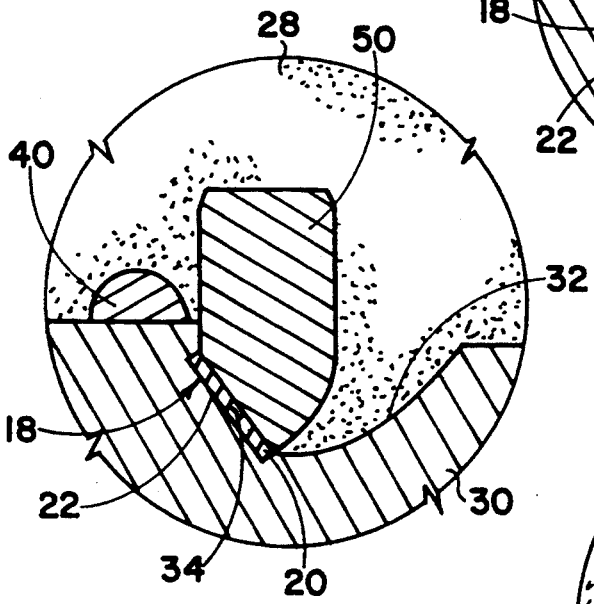

In the embodiment of FIG. 7, diamond layer 20 is bonded to a stud 50 having a different shape than stud 48 in FIG. 6. Layer 20 may be bonded to stud 50 in the same manner as the diamond layer in FIG. 6 is bonded to stud 48. Stud 50 having layer 20 thereon is received in mold 30 packed with powder and infiltrated as described above thereby forming the bit of FIG. 7.

The embodiments of FIGS. 6 and 7 are advantageous in that each of studs 48, 50 is surrounded by infiltrated bit body 28. The studs are thus held securely against mechanical shocks. Prior art studs extend from the bit body and are therefore more susceptible to breakage and cracking produced by mechanical forces during drilling.

In any of the embodiments of FIGS. 3–7, the interior of the mold may be masked and a diamond layer deposited on an unmasked portion of the interior of the mold. Then a metal deposit is formed thereon using conventional techniques. The mold is filled with powder and infiltrated in a furnace thereby bonding the CVD cutting elements formed on the interior of the mold to the bit body.

The embodiments of FIGS. 5–7 are especially suitable for directly depositing diamond onto supporting member 42 or studs 48, 50. The supporting member and studs are sized to be appropriately masked and received in a vapor deposition chamber for directly depositing diamond film thereon.

Figure 8:
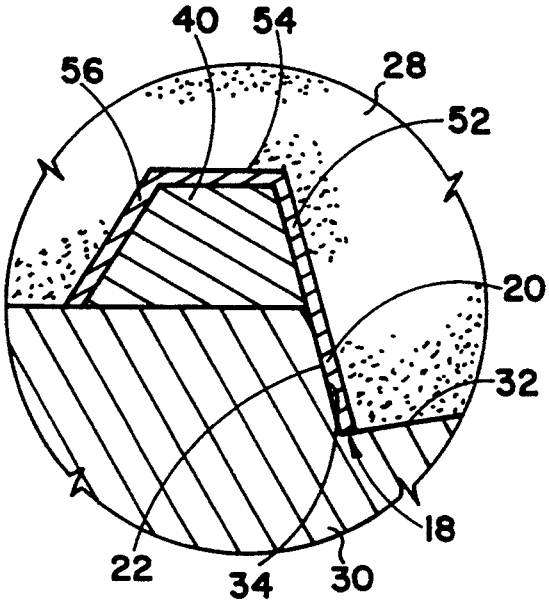

Turning now to FIG. 8, diamond layer 20 extends into a portion 52 integral with layer 20. Additional diamond layers 54, 56 surround portion 40 of the mold. Portion 52 and layers 54, 56 define a fluid course on the exterior of the bit. The deposited diamond layers resist wear which results from drilling fluid flowing in the fluid course. In the embodiment of FIG. 8, portion 52 and layers 54, 56 are substantially planar. It should be appreciated, however, that curved or other configurations of diamond layer formed by deposition as described above may be used to form fluid courses on the drill bit. The deposited diamond layers illustrated in FIG. 8 may be secured to bit body 28 as described in connection with the foregoing embodiments of the present invention.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A drill bit for earth boring comprising:

a body member formed by infiltration in a mold;

a cutting element comprising a layer of diamond formed by vapor deposition sufficiently thick to serve as a drill bit cutting element, said cutting element being mounted on said body member by infiltrating a portion of said body to hold said cutting member during formation of said body member; and a layer of bonding material disposed between said diamond layer and the portion of said body holding said cutting member, said bonding material being in intimate contact with said diamond layer and said body and bonding the same together.

2. The drill bit of claim 1 wherein said bonding material comprises an alloy having a melting temperature substantially greater than 750 degrees Centigrade.

3. A drill bit for earth boring comprising:

a body member formed by infiltration in a mold; and a cutter mounted on said body member by infiltrating a portion of said body to hold said cutter during formation of said body member, said cutter comprising:

a cutting element comprising a layer of diamond formed by vapor deposition sufficiently thick to serve as a drill bit cutting element; and a substrate formed from at least one of the group consisting of metals and ceramics, said cutting element being formed independently of said substrate and thereafter directly secured thereto.

4. The drill bit of claim 3 wherein said substrate comprises a stud.

5. The drill bit of claim 4 wherein said stud is substantially entirely contained within said body member.

6. The drill bit of claim 3 wherein said substrate comprises a carbide substrate.

7. The drill bit of claim 6 wherein said carbide substrate is bonded to said body member.

8. The drill bit of claim 3 wherein said cutting element is secured to said substrate with a brazing alloy.

9. The drill bit of claim 8 wherein said brazing alloy has a melting temperature in excess of the temperature at which polycrystalline diamond degenerates.

10. The drill bit of claim 9 wherein said brazing alloy comprises an alloy having a melting temperature substantially greater than 750 degrees Centigrade.

11. A drill bit for earth boring comprising:

a body member formed by infiltration in a mold; and a cutting element comprising a layer of diamond formed by vapor deposition sufficiently thick to serve as a drill bit cutting element, said cutting element being mounted on said body member by infiltrating a portion of said body to hold said cutting member during formation of said body member, said body portion being in intimate contact with said diamond layer and mechanically securing said layer to said bit body.

12. A drill bit comprising:

a body member;

a cutting element comprising a layer of diamond formed by vapor deposition sufficiently thick to serve as a drill bit cutting element; and an alloy having a melting temperature in excess of the temperature at which polycrystalline diamond degenerates, said cutting element being brazed to said body member using said alloy with said alloy being in direct contact with said cutting element during brazing.

13. The drill bit of claim 12 wherein said alloy comprises an alloy having a melting temperature substantially greater than 750 degrees Centigrade.

* * * * *

UNITED STATES PATENT AND TRADEMARK OFFICE

CERTIFICATE OF CORRECTION

PATENT NO. : 5,337,844

DATED : August 16, 1994

INVENTOR(S) : Gordon A. Tibbitts

It is certified that error appears in the above-identified patent and that said Letters Patent is hereby corrected as shown below:

Column 4, line 33, change "beingmechanically" to -- being mechanically--;

Column 5, line 5, change "the:" to --the--.

Signed and Sealed this

Twenty-first Day of May, 1996

*Attest:*

BRUCE LEHMAN

*Attesting Officer*

*Commissioner of Patents and Trademarks*